United States Patent [19]

Clough, Jr.

[11] 4,092,894

[45] June 6, 1978

[54] MUSICAL SLIDE

[76] Inventor: Roy L. Clough, Jr., 1 N. Curtisville Rd., Concord, N.H. 03301

[21] Appl. No.: 708,718

[22] Filed: Jul. 26, 1976

[51] Int. Cl.[2] ..... G10D 3/00

[52] U.S. Cl. ..... 84/319

[58] Field of Search ..... 84/315–319, 84/322

[56] References Cited

U.S. PATENT DOCUMENTS

| | | | |
|---|---|---|---|
| 1,259,062 | 3/1918 | Wilber | 84/319 |
| 1,741,285 | 12/1929 | Carpenter | 84/322 |
| 2,082,683 | 6/1937 | Carter | 84/319 |
| 2,184,733 | 12/1939 | Burgien | 84/319 |
| 2,441,713 | 5/1948 | Miller | 84/319 |
| 2,650,513 | 9/1953 | Miller | 84/319 |
| 3,922,945 | 12/1975 | Pettijohn | 84/319 |

*Primary Examiner*—Stephen J. Tomsky
*Attorney, Agent, or Firm*—Schiller & Pandiscio

[57] ABSTRACT

A hand held device for use in varying the pitch of at least one string of a flat bodied stringed musical instrument. The device comprises an elongated body beveled at opposite ends so as to provide first and second mutually convergent surfaces. The length of the body is such that when the body is held in the user's hand, one beveled end engages the palm, while simultaneously the other end may be engaged by the ball of the index finger. The device also includes a loop member attached to the body and formed so as to extend between the index and middle fingers of the hand and around the top of the index finger in a loose manner so that the body can be securely held in the hand and so that the index finger can be arched to vary the pressure exerted on the body.

11 Claims, 3 Drawing Figures

MUSICAL SLIDE

This invention relates generally to devices for use in varying the pitch of one or more strings of a flat bodied stringed musical instrument and more particularly to improved devices commonly referred to as steels, bars or slides.

Flat bodied stringed musical instruments including those instruments commonly known as steel quitars, pedal steel guitars, "Dobro" or Hawaiian guitars, generally include a plurality of strings, usually strung from one end of the instrument to the other, with a resonating cavity or electrical pick-up at one end and a key or finger board at the other. The strings are usually of various gauges and thicknesses, tensioned so that they will vibrate at a selected resonant frequency or note. Vibration of a string over the resonant cavity will produce an acoustic signal representative of these vibrations at the particular frequency. Similarly, these vibrations can be sensed by electrical pick-ups so as to provide an electrical signal representative of these acoustic signals.

Generally, the strings are tensioned or tuned so that when they vibrate together, such as by plucking them with a plectrum or similar device, they can produce various chords and harmonics.

By applying pressure to one or more of the strings against the key or finger board, e.g., stopping the strings by using a slide, the length of the portion of the string or strings which vibrates is changed so as to change the resonant frequency and thus the note produced by the vibrations. In this way various notes and chords can be played.

Various types of slides for various string instruments are known. Early slides, generally having rectangular or flat shapes with rounded edges, have generally fallen out of use since they produce an inferior tone and are not easy to manipulate. Another class of slides which have been used include short-lengths of tubing or curved plates formed in semi-cylindrical shapes and sized so that they can be slipped over the playing finger. This last class of slide is usually used for a particular style of playing upon a Spanish-type guitar tuned to an open string-chord, and held in a conventional manner. The slide is used in addition to normal finger stopping techniques. Such slides are small and narrow and, because of the way in which they are worn by the user, are quite impractical for the horizontally-played steel guitars to which the present invention more specifically relates.

With respect to horizontally-played steel guitars, one common type of slide in current use is simply a cylindrical bar of polished metal with one end being formed as a flat surface at a right angle to the cylindrical axis of the bar and the other end being formed as a bullet or hemispherical nose. Another type of slide in current use is an elongated bar having both ends formed as flat surfaces at right angles to the elongate axis of the bar and generally shaped to have a substantially hour-glass cross-sectional shape with the bottom (i.e., that portion of the slide which is adapted to contact the strings) rounded and the top flat or somewhat grooved to facilitate handling.

It is generally recognized that holding and manipulating such slides can be quite difficult as well as annoying, and usually constitutes one of the first obstacles to be overcome in learning to perform upon the instrument.

The player can lose control and even drop the slide. The fact that the slide is fairly massive tends to limit playing techniques. This is particularly true of modern instruments which have grown from six strings which require a relatively small slide to cover all the strings, to ten and twelve strings, requiring a relatively larger slide. Further, where the slide is provided at one or both ends with substantially flat surfaces formed at right angles to its elongated axis, the slide can become uncomfortable to hold because of sharp edges engaging portions of the playing hand. Further, these end surfaces make it difficult if not impossible to "reach inside", a technique in which a particular string is stopped while its adjacent strings are left in an open playable position. Additionally, these sharp edges can hook one or more strings when moving the slide transversely to the strings.

It is the primary object of the present invention to provide an improved slide particularly useful with various flat bodied stringed musical instruments, and in particular pedal steel guitars, which substantially reduces the aforementioned problems.

More specific objects of the present invention are to provide an improved slide that is easy to hold and manipulate, is of relatively low mass and is shaped so as to permit relatively easy execution of normally difficult techniques.

These and other objects of the present invention are achieved by a hand-held device comprising an elongated body beveled at opposite ends so as to provide first and second mutually converging surfaces. The length of the body is such that when the body is held in the user's hand, one beveled end may be more comfortably engaged by the palm of that hand while simultaneously the other beveled end can be comfortably engaged by the ball of the playing finger. The device also includes means, in the form of a U-shaped loop member, adapted to extend between the playing and adjacent fingers and formed to curl around the playing finger so that the playing finger can be arched to vary the pressure on the body.

Other features and many of the attendant advantages of the invention are disclosed in or rendered obvious by the following detailed description which is to be considered together with the accompanying drawings in which.

In the drawings, like numerals refer to like parts. Also, for purposes of illustration, the embodiments are drawn on a magnified scale so that various details are more easily discernable.

Figure 1:
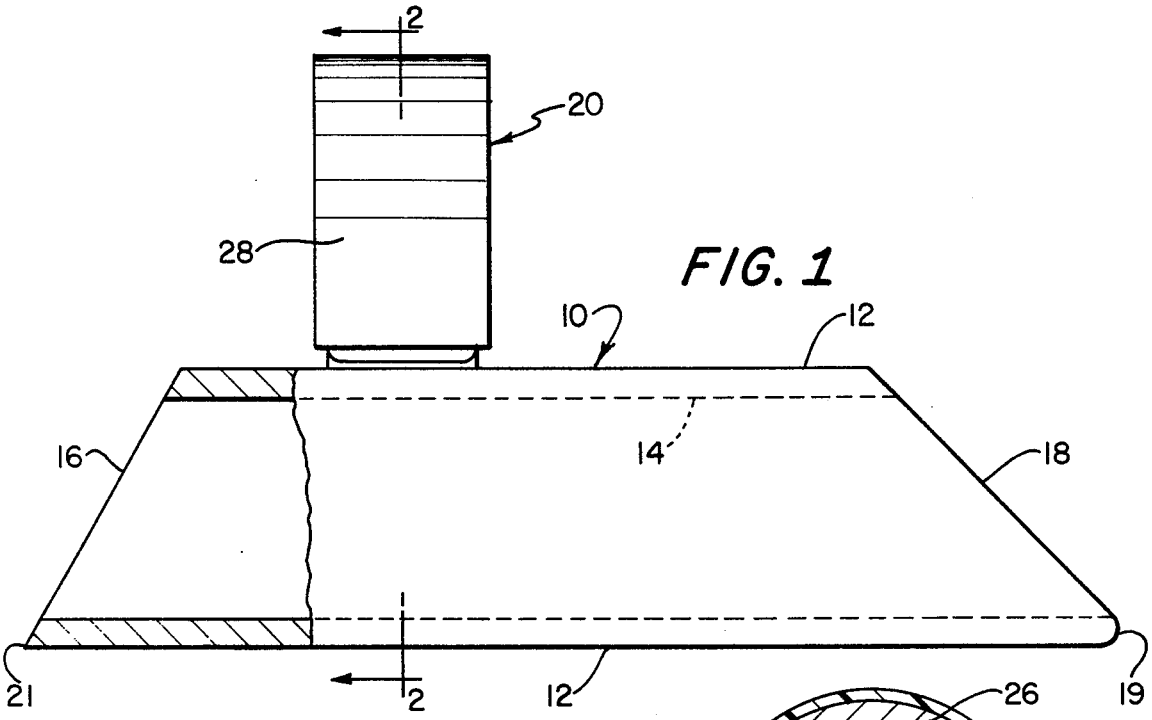
FIG. 1 is a side view, partially in longitudinal-section, of one embodiment of the present invention.

Referring to FIG. 1, a device made in accordance with the present invention comprises an elongated body 10 formed so as to have an outer cylindrical surface 12 and a hollow interior 14. The body is preferably made of a metal such as brass, iron or steel in a manner well known in the art, such as rolling, casting or extruding, although other materials and methods of forming the body will be well known to those skilled in the art. The thickness of the shell of the body is sufficient so that pressure can be exerted in a direction at a right angle to the longitudinal axis of the body to stop one or more strings of the instrument without modifying the shape of the body.

The body 10 is beveled at its opposite ends so as to provide mutually convergent surfaces 16 and 18. More specifically, each end of the body is preferably formed so that the surface 16 at the forward end (the end which is engagable with the ball of the index or playing finger of the player) being at approximate angles of 45° to 60° to the longitudinal axis of body 10, while the surface 18 at the back end 18, (the end which engages the palm of the hand of the player) being at an angle of approximately 45° to the same axis. Both ends of the body are open as shown in FIG. 1 so as to provide a relatively low mass body.

Preferably, the bottom edge portion 19 formed by the intersection of outer surface 12 and the back end surface 18 is rounded so as to provided a "sled runner effect" in order to minimize the chances of hooking a string with the back end when moving the slide transversely to the strings in a direction toward the player. Preferably also, the bottom edge portion 21 formed by the intersection of the outer surface 12 and the forward end surface 16, is relatively sharp so as to make it relatively easy for the player to reach inside, i.e., to select and stop a particular string in various positions while leaving adjacent strings in an open playable position.

A U-shaped loop or strap member 20 is provided so that the device can be securely held in the user's hand. The loop member 20 is made of any suitable material, such as metal or the like and includes at one end a flat portion 22, attached to the side of body 10 near the forward end 16, by any suitable means such as cement 24 or the like. The other end of loop member 20 is formed with a curl or hook 26. The loop member is sized so that the flat portion 22 can be held between the index and middle fingers of the player's hand, while the hook 26 extends over at a slight distance from the index finger so that the latter can be arched in order to exert in varied manner, pressure on the forward end 16 of the body. In the preferred form of the invention, a sheath 28, made of a resilient material such as rubber or plastic, is fitted over loop member 22 so as to surround and substantially conform to the shape of the loop member.

In use, the device is held in the hand of the player so that the back end 18 engages the palm of the hand and the forward end 16 is simultaneously engageable with the ball of the player's index finger while flat portion 20 of loop member 22 is positioned between the middle and index fingers with curl 26 extending over and around the index finger. When held in this manner, the slide can be manipulated easily with little possibility of it dropping or slipping inadvertently. Thus, the slide is under the full control of the player even when the player is attempting heretofore difficult techniques, such as twisting (diagonally slanting the slide) and vibration (or high speed shimmying of the slide to induce and control expression). Further sheath 28 provides greater comfort to the user.

The preferred angles of 45° to 60° and 45° of end surfaces 16 and 18 respectively, and the general shape and proportions of the slide, are such that the joint of the index finger naturally conforms to the forward end surface while the back end surface is simultaneously and comfortably engaged by the palm of the user's hand, thereby permitting greater coverage of the strings with little, if any, discomfort to the player. The beveled ends also reduce the mass of the slide so as to provide greater ease to the user in executing rapid passages.

Figure 2:
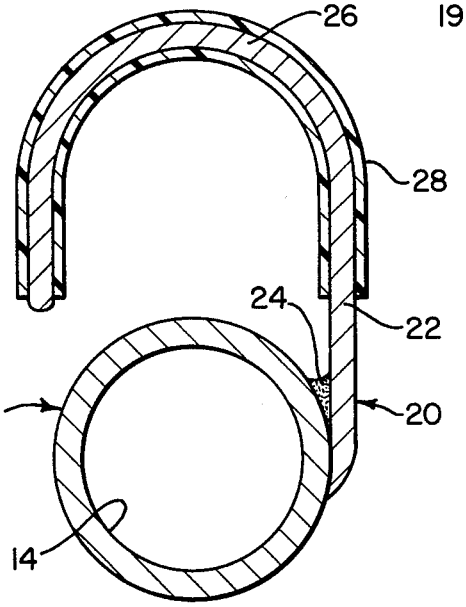
FIG. 2 is a cross-sectional view taken along line 2 — 2 of FIG. 1.
Figure 3:
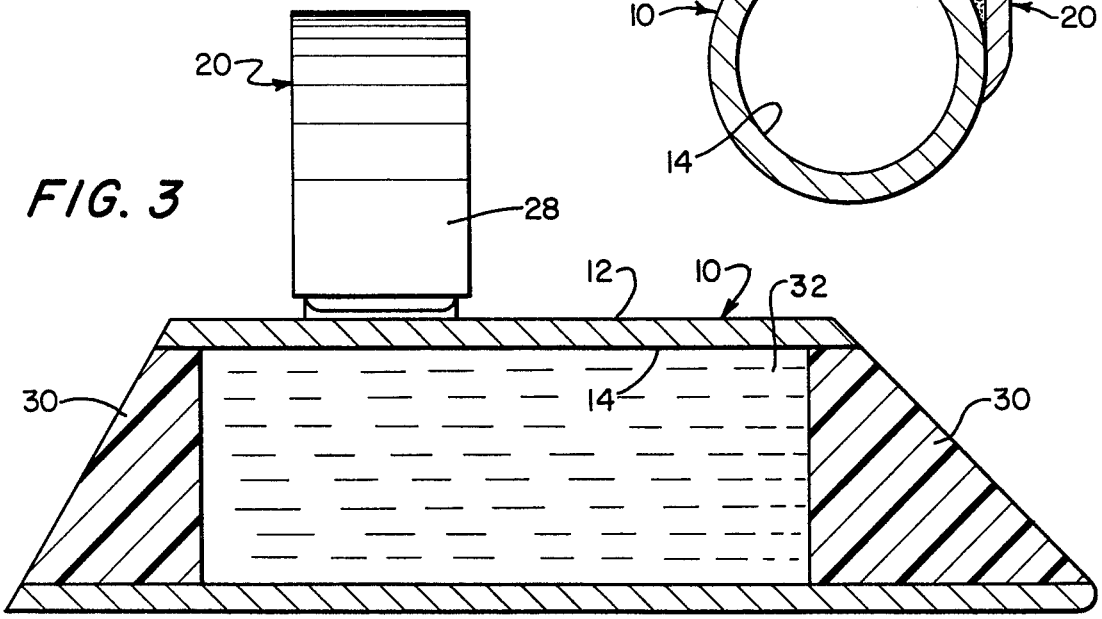
FIG. 3 is a side view, partially in longitudinal-section, of another embodiment of the present invention.

FIG. 3 shows a modified form of the invention. In this case the slide shown is identical to the slide described and shown in FIGS. 1 and 2, except that each end is provided with end plugs 30 which are secured to the body 10 in any one of several known ways, e.g., by a friction fit or by means of a locking pin or a cement. The plugs are shaped so as to be flush with end surfaces 16 and 18. In this embodiment the plugs 30 can be hermetically sealed to the body 10 so that the body can be partially or wholly filled with a liquid or solid material 32 selected so as to damp spurious vibrations and produce subtle alterations in tonal quality without increasing the mass of the slide to the extent provided by a solid metal slide.

The invention as herein described provides an improved slide having several advantages. The slide is easy to hold and manipulate by virtue of the beveled end surfaces 16 and 18, member 20 and the low mass of the slide. Further the shape of the slide enables the player to execute heretofore relatively difficult techniques in an relatively easy manner. The edge portion 19 makes it easier to slide the device transversely across the strings toward the player without hooking a string, while end portion 21 makes it easier to reach inside, the latter techniques being largely impractical with the heavy bullet-nosed slides of the prior art.

It will be appreciated that all matter contained in the above description or shown in the accompanying drawing shall be interpreted as illustrative and not in a limiting sense.

What is claimed is:

1. A device for use in varying the pitch of one or more strings of a stringed musical instrument, said device comprising an elongated body adapted to be hand held and being beveled at its opposite ends so as to provide front and back mutually converging end surfaces, the length of said body being such that when said body is held in a user's hand, one beveled end may be engaged by the palm of that hand while simultaneously a finger of that hand may be engaged with the other beveled end; and a loop member having one end fixedly secured to a side of said elongated body and its other end free and further having a U-shaped portion spaced from said elongated body and formed to extend around the use's index finger so that the said index finger can be arched in order to exert, in a varied manner, pressure on the front end of said body.

2. A device according to claim 1, wherein said body is hollow.

3. A device according to claim 2, wherein said body is cylindrical.

4. A device according to claim 3, wherein said body is open at said opposite ends.

5. A device in accordance with claim 3, wherein said body is hollow and is closed at said opposite ends.

6. A device according to claim 5, further including plugs inserted in said opposite ends.

7. A device according to claim 5, wherein said hollow body is filled with a fluid.

8. A device according to claim 1 further including a sheath surrounding and substantially conforming to the shape of said loop member.

9. A device according to claim 1, wherein said body has an outer surface intersecting said opposite ends, and the junction of a portion of said outer surface and one of said beveled ends is relatively rounded and at least the bottom edge portion formed by the junction of said outer surface and the other beveled end is relatively sharp.

10. A device according to claim 1 wherein said mutually converging end surfaces are substantially planar and one of said end surfaces is disposed at a 45° angle to the longitudinal axis of said body and the other of said end surfaces is disposed at a 60° angle to said axis.

11. A device according to claim 1 wherein said loop member is bendable so that the distance between said U-shaped portion and said elongated body can be varied.

* * * * *